US009035987B2

(12) United States Patent
Yamawaki

(10) Patent No.: US 9,035,987 B2
(45) Date of Patent: May 19, 2015

(54) IMAGE FORMING APPARATUS, INCLUDING A LIGHT SCANNING APPARATUS THAT EMITS A LIGHT FLUX

(71) Applicant: CANON KABUSHIKI KAISHA, Tokyo (JP)

(72) Inventor: Takeshi Yamawaki, Tokyo (JP)

(73) Assignee: CANON KABUSHIKI KAISHA (JP)

( * ) Notice: Subject to any disclaimer, the term of this patent is extended or adjusted under 35 U.S.C. 154(b) by 0 days.

(21) Appl. No.: 14/154,259

(22) Filed: Jan. 14, 2014

(65) Prior Publication Data

US 2014/0204165 A1 Jul. 24, 2014

(30) Foreign Application Priority Data

Jan. 23, 2013 (JP) ..... 2013-009932

(51) Int. Cl.
*B41J 2/455* (2006.01)
*G03G 15/043* (2006.01)

(52) U.S. Cl.
CPC ..... *G03G 15/0435* (2013.01)

(58) Field of Classification Search
USPC ..... 347/225, 229, 232–234, 248
See application file for complete search history.

(56) References Cited

U.S. PATENT DOCUMENTS

2012/0050827 A1* 3/2012 Taniguchi et al. ..... 358/505

FOREIGN PATENT DOCUMENTS

| | | | | | |
|---|---|---|---|---|---|
| JP | 08-207354 | A | | 8/1996 | |
| JP | 2001-066531 | A | | 3/2001 | |
| JP | 2003-107841 | A | | 4/2003 | |
| JP | 2003-159836 | A | | 6/2003 | |
| JP | 2003-162122 | A | | 6/2003 | |
| JP | 2004-021142 | A | | 1/2004 | |
| JP | 2007-065475 | A | | 3/2007 | |
| JP | 2008-122433 | A | | 5/2008 | |
| JP | 2008-139420 | A | | 6/2008 | |
| JP | 2008-139626 | A | | 6/2008 | |
| JP | 2008139420 | A | * | 6/2008 | ..... G03G 15/01 |
| JP | 2009-169031 | A | | 7/2009 | |
| JP | 2010-097106 | A | | 4/2010 | |
| JP | 2012-053250 | A | | 3/2012 | |

* cited by examiner

*Primary Examiner* — Hai C Pham
(74) *Attorney, Agent, or Firm* — Rossi, Kimms & McDowell LLP

(57) ABSTRACT

Provided is an image forming apparatus including a light scanning apparatus that emits a light flux to photosensitive surfaces of a plurality of photosensitive bodies arranged so that longitudinal directions are the same direction and that optically scans the plurality of photosensitive surfaces in the longitudinal direction, wherein a diameter of at least one of the plurality of photosensitive bodies is different from diameters of the other photosensitive bodies in a cross section perpendicular to the longitudinal direction, and in the cross section perpendicular to the longitudinal direction, a sign of θ1 and a sign of θ2 are different, wherein θ1 denotes an incident angle of a light flux incident on a first photosensitive body with a smallest diameter among the plurality of photosensitive bodies, and θ2 denotes an incident angle of a light flux incident on a second photosensitive body with a largest diameter, and a condition |θ1|>|θ2|>0 is satisfied.

9 Claims, 3 Drawing Sheets

IMAGE FORMING APPARATUS, INCLUDING A LIGHT SCANNING APPARATUS THAT EMITS A LIGHT FLUX

BACKGROUND OF THE INVENTION

1. Field of the Invention

The present invention relates to an image forming apparatus including a plurality of photosensitive bodies, and particularly, the present invention is suitable for an image forming apparatus including photosensitive bodies with different diameters.

2. Description of the Related Art

Conventionally, regular reflected light (return light noise) generated by perpendicular incidence (incident angle is zero) of a laser beam on a photosensitive surface is a problem when a light scanning apparatus scans on the photosensitive surface of a photosensitive body in an image forming apparatus. More specifically, the regular reflected light from the photosensitive surface of the photosensitive body returns to a laser light source through the same optical path as the incident optical path. The output of the laser light source becomes unstable, and the image is degraded. A configuration for solving the problem is known, wherein the laser beam from the laser light source enters at an angle relative to a surface normal line of the photosensitive surface of the photosensitive body, in a cross section (sub-scanning cross section) perpendicular to the main scanning direction.

To form a color image, an image forming apparatus including a plurality of photosensitive bodies (image bearing members) corresponding to the colors is known. Japanese Patent Application Laid-Open No. 2003-162122 discloses a configuration, wherein a plurality of photosensitive bodies is arranged on an arch, and incident angles of laser beams in the sub-scanning cross section are set to different angles in the photosensitive bodies.

The use frequency of the photosensitive body for black is generally the highest among the plurality of photosensitive bodies corresponding to the colors. Therefore, the diameter of the photosensitive body for black can be greater than the diameters of the other photosensitive bodies to increase the lifetime of the photosensitive body for black. The minimum value of the incident angle for avoiding the regular reflected light from returning to the laser light source depends on the diameter of the photosensitive body. Therefore, if the diameters of the photosensitive bodies are different, the incident angles of the laser beams relative to the photosensitive bodies need to be appropriately set.

However, all of the diameters of the photosensitive bodies are the same in the image forming apparatus described in Japanese Patent Application Laid-Open No. 2003-162122, and setting of appropriate incident angles for a plurality of photosensitive bodies with different diameters is not disclosed.

SUMMARY OF THE INVENTION

An object of the present invention is to suppress generation of return light noise caused by regular reflected light from a plurality of photosensitive bodies with different diameters in an image forming apparatus including the photosensitive bodies.

To attain the object, the present invention provides an image forming apparatus including a light scanning apparatus that emits a light flux to photosensitive surfaces of a plurality of photosensitive bodies arranged so that longitudinal directions are the same direction and that optically scans the plurality of photosensitive surfaces in the longitudinal direction, wherein a diameter of at least one of the plurality of photosensitive bodies is different from diameters of the other photosensitive bodies in a cross section perpendicular to the longitudinal direction, and in the cross section perpendicular to the longitudinal direction, a sign of $\theta 1$ and a sign of $\theta 2$ are different, wherein $\theta 1$ (rad) denotes an incident angle of a light flux incident on a first photosensitive body with a smallest diameter among the plurality of photosensitive bodies, and $\theta 2$ (rad) denotes an incident angle of a light flux incident on a second photosensitive body with a largest diameter, and a condition $|\theta 1|>|\theta 2|>0$ is satisfied.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

<<First Embodiment>>

(Image Forming Apparatus)

Figure 3:
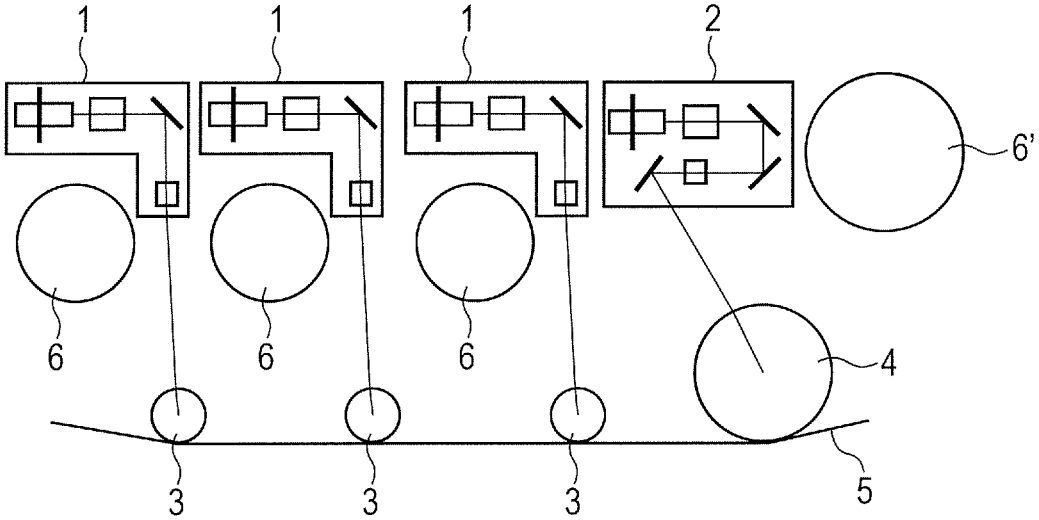
FIG. 3 is a schematic diagram of an image forming apparatus according to an embodiment of the present invention.

An image forming apparatus according to an embodiment of the present invention illustrated in FIG. 3 includes a plurality of photosensitive bodies (image bearing members) arranged so that the longitudinal directions are the same direction, wherein at least one of the plurality of photosensitive bodies has a different diameter.

Specifically, the image forming apparatus includes light scanning apparatuses 1 for color, a light scanning apparatus 2 for black, photosensitive bodies 3 for color (first photosensitive bodies) and a photosensitive body 4 for black (second photosensitive body). The light scanning apparatuses scan the corresponding photosensitive bodies in the longitudinal direction (main scanning direction). Among the plurality of photosensitive bodies, the photosensitive bodies 3 for color are photosensitive drums with a diameter of 30 mm, and the photosensitive body 4 for black is a photosensitive drum with a diameter of 84 mm. In this way, the diameter of the photosensitive body 4 for black is greater than the diameter of the photosensitive bodies 3 for color in view of the use frequency.

Lower surfaces of the photosensitive bodies are in contact with a transfer belt 5 at equal intervals. Images depicted on photosensitive body surfaces by the light scanning apparatuses are primarily transferred to the transfer belt 5, and combined images are secondarily transferred to a recording sheet. Toner reservoirs 6 and 6' are arranged on the sides of the photosensitive bodies corresponding to the colors. Since the print frequency of black is particularly high, the toner reservoir 6' for black is greater than the toner reservoirs 6 for color.

In the color image forming apparatus, the space for the light scanning apparatuses is limited due to the difference in the diameter between the photosensitive bodies for color and black and the difference in the size between the toner reservoirs. Therefore, the positions of the light beams directed from the light scanning apparatuses to the photosensitive bodies are not the same. Certain incident angles need to be set to avoid (prevent) regular reflected light in the photosensitive bodies. The incident angles need to be determined as described below in consideration of the difference in the size between the photosensitive bodies.

(Regular Reflected Light Avoidance Conditions)

Figure 1A:
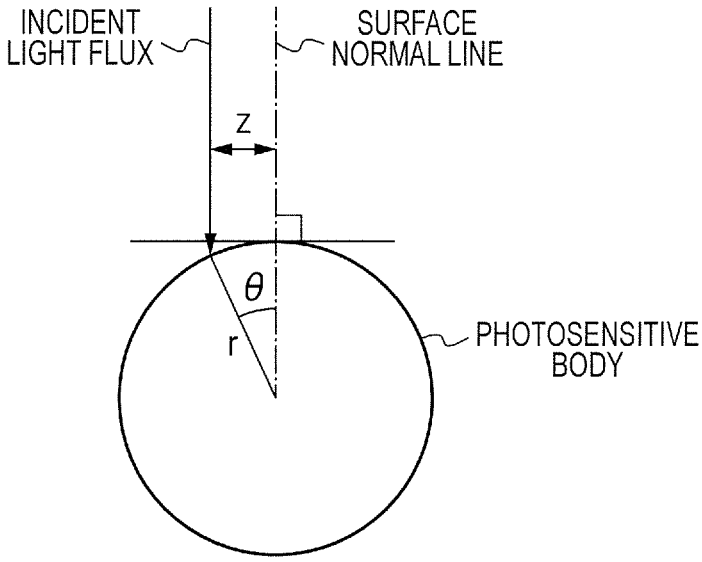
FIG. 1A is a diagram for describing a regular reflected light avoidance condition.

A condition for avoiding the regular reflection (regular reflected light avoidance condition) when incident position displacement (so to say, parallel eccentricity) due to an installation error such as parallel eccentricity of the photosensitive bodies is taken into account will be described first. The incident position of the scanning light flux on the photosensitive surface needs to be shifted in the sub-scanning direction (rotation direction of photosensitive body) to avoid the regular reflected light as illustrated in FIG. 1A, wherein the diameter of the photosensitive body is $\phi$ (mm) (radius $r=\phi/2$), and the incident angle is $\theta$ (rad).

In this case, an amount of shift Z (mm) of the incident position needs to satisfy the following Expressions (1) and (1') in consideration of the installation errors of the light scanning apparatuses and the photosensitive bodies. The right side of Expression (1) indicates that the position of the incident light flux incident on the photosensitive body needs to be shifted by at least 1.5 mm in the circumferential direction of the photosensitive body from the incident position of the regular reflection.

$$Z=\phi/2\cdot|\theta|\geq 1.5\ (\mathrm{mm}) \tag{1}$$

$$|\theta|\geq 3/\phi \tag{1'}$$

As can be understood from Expression (1'), the magnitude of the smallest incident angle $|\theta\ \mathrm{min}|(=3/\phi)$ for avoiding the regular reflected light can be reduced with an increase in the diameter $\phi$ of the photosensitive body.

Figure 1B:
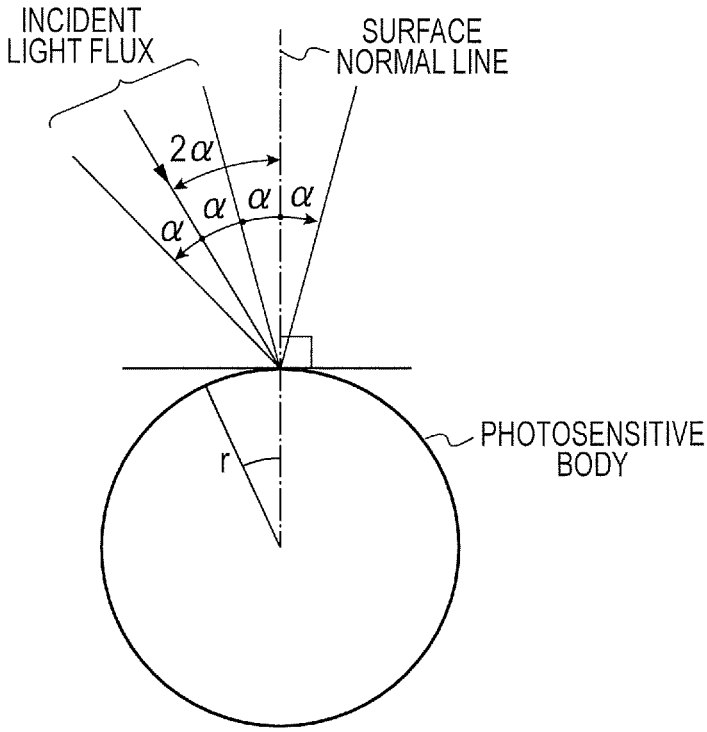
FIG. 1B is a diagram for describing a regular reflected light avoidance condition.

For another regular reflected light avoidance condition, the incident angle needs to be set in consideration of the angle of the marginal light beam (so to say, inclination eccentricity) relative to the main light beam of the scanning light flux. When the scanning light flux on the photosensitive body is taken into account in FIG. 1B, an angle $\alpha$ (rad) of the marginal light beam relative to the main light beam is $\alpha=1/(2F)$, wherein F denotes an f-number of the light flux. To avoid the marginal light beam from becoming return light noise, the marginal light beam needs not to coincide with the surface normal line as in FIG. 1A. More specifically, the following Expression (2) needs to be satisfied.

$$|\theta|>2\alpha \tag{2}$$

In this way, the value of $|\theta|$ that needs to be set as the magnitude of the incident angle for avoiding the regular reflection can be described by the following Expression (3) based on the sum of the minimum values of Expressions (1') and (2).

$$|\theta|\geq 3/\phi+2\alpha \tag{3}$$

Therefore, it can be understood from Expression (3) that a larger incident angle $\theta$ needs to he provided with a decrease in the diameter $\phi$ of the photosensitive body. More specifically, if the smallest incident angle is set according to the second photosensitive body with the largest diameter, the angle is not enough to avoid the regular reflection in the first photosensitive bodies with the smallest diameter. Therefore, a condition $|\theta\mathbf{1}|>|\theta\mathbf{2}|>0$needs to be satisfied to avoid the regular reflected light, wherein $\theta\mathbf{1}$ denotes the incident angle relative to the photosensitive surfaces of the photosensitive bodies 3, and $\theta\mathbf{2}$ denotes the incident angle relative to the photosensitive surface of the photosensitive body 4.

If the incident angle is set according to the first photosensitive bodies, an unnecessarily large incident angle is provided to the second photosensitive body. Therefore, the upper limit of the incident angle relative to the first photosensitive bodies will be determined based on a condition for keeping the enlargement of a spot diameter projected on the photosensitive body surface equal to or less than 10%. This is because if the enlargement of the spot diameter is not kept equal to or less than 10%, the formed image is more degraded, and a better image cannot be obtained.

(Regular Reflected Light Avoidance Condition in Light Scanning Apparatuses for Color)

Expression (1') can be described by the following Expression (1'a) based on $\theta\mathbf{1}=30$ mm in the present embodiment, wherein $\theta\mathbf{1}$ denotes the incident angle of the light flux incident on the photosensitive surface of the photosensitive body 3, and $\phi\mathbf{1}$ denotes the diameter of the photosensitive body 3.

$$|\theta 1|\geq 3/\phi 1=0.1(\mathrm{rad}) \tag{1'a}$$

Based on spot diameter $S=kF\lambda$ ($k=1.64$) and $\alpha=1/(2F)$, $\alpha=0.5\cdot k\lambda/S$ can be obtained, wherein $\lambda$ denotes the wavelength of the light flux incident on the photosensitive surface of the photosensitive body 3, and S denotes the spot diameter on the photosensitive surface in the sub-scanning direction. From this, Expression (2) described above can be described by the following Expression (2a). In the present embodiment, spot diameter is $S=50$ μm at wavelength $\lambda=0.67$ μm.

$$|\theta 1|>2\alpha=1.64\lambda/S=0.022(\mathrm{rad}) \tag{2a}$$

In this way, the regular reflected light avoidance condition in consideration of the spot diameter in the photosensitive body 3 can be described by the following Expression (3a) based on the sum of the minimum values of Expressions (1'a) and (2a).

$$|\theta 1|\geq 3/\phi 1+1.64\lambda/S=0.122(\mathrm{rad}) \tag{3a}$$

Figure 4A:
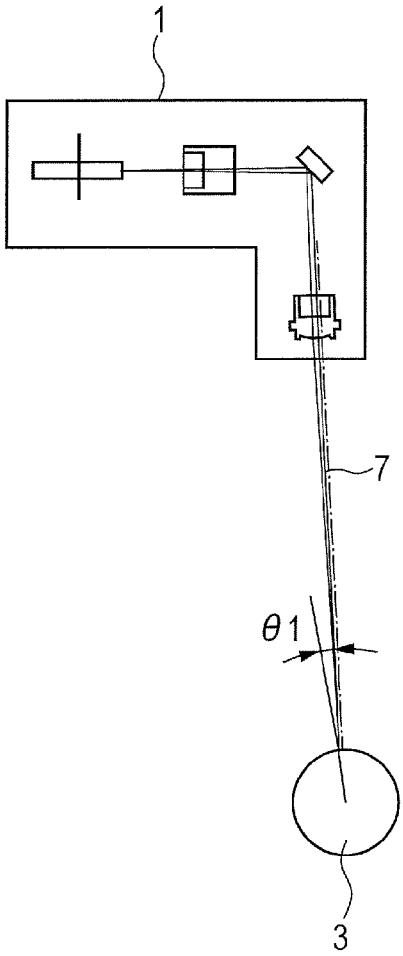
FIG. 4A is a diagram illustrating a relationship between a light scanning apparatus and a photosensitive body.

In the present embodiment, the magnitude of the incident angle of a light flux 7 is $|\theta\mathbf{1}|=0.122$ rad as illustrated in FIG. 4A, and Expression (3a) is satisfied. Therefore, the regular reflected light is avoided.

Figure 2:
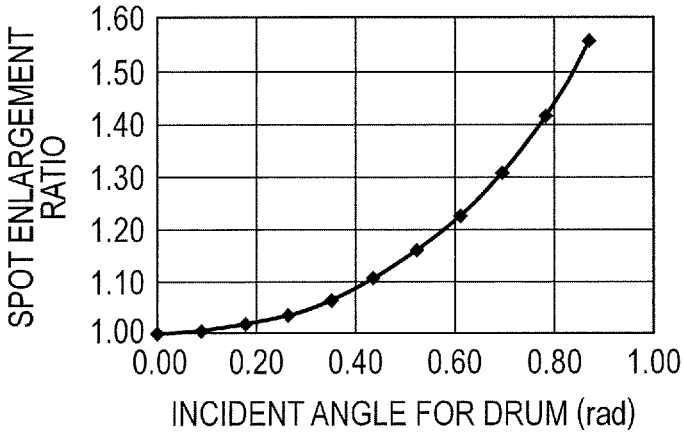
FIG. 2 is a diagram illustrating a relationship between an incident angle and a spot enlargement ratio.

The ratio of the enlargement of the spot diameter by the projection at the incident angle $\theta\mathbf{1}$ on the photosensitive body 3 can be expressed by $1/\cos\theta$ as illustrated in FIG. 2. In the present embodiment, the spot enlargement is 0.7% at most based on $1/\cos\theta\mathbf{1}=1.007$. Therefore, the enlargement of the spot diameter is kept equal to or less than 10%.

(Regular Reflected Light Avoidance Condition in Light Scanning Apparatus for Black).

Meanwhile, Expression (1') can be described by the following Expression (1'b) based on $\phi\mathbf{2}=84$ mm in the present embodiment, wherein $\theta\mathbf{2}$ denotes the incident angle of the light flux incident on the photosensitive surface of the photosensitive body 4, and $\theta\mathbf{2}$ denotes the diameter of the photosensitive body 4.

$$|\theta 2|\geq 3/\phi 2=0.036(\mathrm{rad}) \tag{1'b}$$

Expression (2) described above can be described by the following Expression (2b) in the same way as Expression (2a).

$$|\theta 2|\geq 2\alpha=1.64\lambda/S=0.022(\mathrm{rad}) \tag{2b}$$

Based on Expressions (1'b) and (2b), the regular reflected light avoidance condition in consideration of the spot diameter in the photosensitive body 4 can be described by the following Expression (3b).

$$|\theta 2| \geq 3/\phi 2 + 1.64\lambda/S = 0.058(\text{rad}) \quad (3b)$$

Figure 4B:
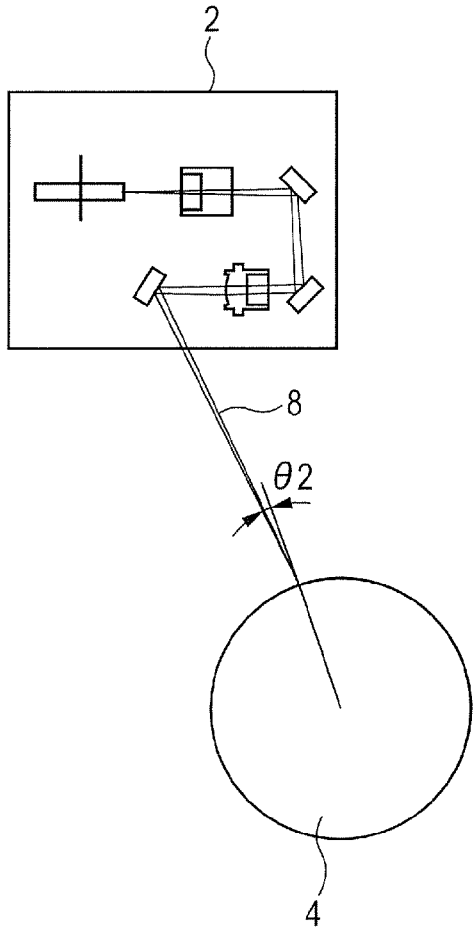
FIG. 4B is a diagram illustrating a relationship between a light scanning apparatus and a photosensitive body.

In the present embodiment, the magnitude of the incident angle of a light flux 8 is $|\theta 2|=0.087$ (rad) as illustrated in FIG. 4B. Expression (3b) is satisfied, and the regular reflected light is avoided. The spot enlargement is 0.4% at most based on $1/\cos\theta 2=1.004$, and the enlargement of the spot diameter is kept equal to or less than 10%.

(Difference in Directionality between Incident Light on Photosensitive Bodies for Color and Incident Light on Photosensitive Body for Black)

As illustrated in FIGS. 4A and 4B, the incident light fluxes 7 and 8 for the photosensitive bodies 3 for color and the photosensitive body 4 for black form the incident angles $\theta 1$ and $\theta 2$ to avoid the regular reflected light. The incident light fluxes 7 and 8 enter from different sides relative to the surface normal lines. More specifically, $\theta 1$ and $\theta 2$ are angles in different directions (angles with different signs) relative to the surface normal lines of the photosensitive bodies. The reason will be described using the part illustrated in FIG. 3 where the light scanning apparatus 1 for color and the light scanning apparatus 2 for black are arranged adjacent to each other.

The lower surfaces of the photosensitive body 3 for color and the photosensitive body 4 for black come in contact with the transfer belt 5 at the same height. Therefore, the upper surface of the photosensitive body 4 for black with a large diameter approaches the optical system in the light scanning apparatus 2 for black, and the space between the upper surface and the optical system is small. Therefore, even if the optical path is folded by mirrors as illustrated in FIG. 3, the light flux needs to be obliquely incident on the photosensitive body 4. Thus, the incident light flux 8 enters from the left side relative to the surface normal line of the photosensitive body 4 for black as illustrated in FIG. 4B.

On the other hand, the photosensitive bodies 3 for color have small diameters, and the intervals for arranging the photosensitive bodies 3 for color are narrowed down to downsize the entire apparatus. Therefore, the central axis of the photosensitive body 3 for color is shifted to the right side (toward the photosensitive body 4 for black) relative to the light flux that enters vertically downward from the optical system in the light scanning apparatus 1 for color. As a result, the incident light flux 7 enters from the right side relative to the surface normal line of the photosensitive body 3 for color as illustrated in FIG. 4A. In this way, the directions of the incident angles of the light fluxes relative to the photosensitive bodies are designed to be different in the configuration with a plurality of photosensitive bodies with different diameters. This can downsize the entire apparatus even if the same optical system is used in the light scanning apparatuses.

The following Expression (5) can be further satisfied, wherein $\phi 1$ denotes the diameter of the first photosensitive body, and $\phi 2$ denotes the diameter of the second photosensitive body.

$$0.43 > |\theta 1| > |\theta 2| \geq 3/\phi 2 + 1.64\lambda/S \quad (5)$$

Setting the incident angle $\theta 1$ not to exceed the upper limit 0.43 (rad) as in Expression (5) can keep the enlargement of the spot of a light flux incident on the first photosensitive body equal to or less than 10%. The lower limit is based on the same reason as in Expression (3a).

The amounts of spot diameter enlargement between the photosensitive bodies can be arranged equal to or less than 5% to ensure the uniformity of the image quality in the first photosensitive bodies and the second photosensitive body. More specifically, the following Expression (6) can be satisfied, wherein the difference in the magnitude between the incident angles of the light fluxes incident on the photosensitive bodies is $\Delta\theta$ (rad). The difference between the angle for the first photosensitive body and that for the second photosensitive body is $\Delta\theta = \|\theta 1| - |\theta 2\|$.

$$0.31 \geq \Delta\theta \quad (6)$$

As described, in the image forming apparatus according to the present embodiment, the incident angle of the light flux incident on the first photosensitive body with the smallest diameter and the incident angle of the light flux incident on the second photosensitive body with the largest diameter are appropriately set in the cross section perpendicular to the longitudinal direction of the photosensitive bodies. This can appropriately suppress the generation of the regular reflected light in the configuration with a plurality of photosensitive bodies with different diameters. A better image can be obtained by setting the spot enlargement on the photosensitive surface of the first photosensitive body with a large incident angle equal to or less than 10%.

(Modified Examples)

Although the exemplary embodiment of the present invention has been described, the present invention is not limited to the embodiment, and various modifications and changes can be made within the scope of the present invention.

In the embodiment, four photosensitive bodies including a photosensitive body for black for forming a color image are included as a plurality of photosensitive bodies including the first photosensitive bodies with the smallest diameter and the second photosensitive body with the largest diameter, and the second photosensitive body is a photosensitive body that forms a black image. However, the present invention is not limited to this. For example, two photosensitive bodies including a photosensitive body for black may be provided, and the second photosensitive body may be a photosensitive body that forms an image other than black.

In the embodiment, the light scanning apparatuses are four independent light scanning apparatuses. The light scanning apparatus for black and the light scanning apparatuses for colors other than black have different configurations, and the light scanning apparatuses for colors other than black have the same configuration. However, the present invention is not limited to this. For example, the light scanning apparatuses for colors other than black may have different configurations.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-009932, filed Jan. 23, 2013, which is hereby incorporated by reference herein in its entirety.

What is claimed is:

1. An image forming apparatus comprising a light scanning apparatus that emits a light flux to photosensitive surfaces of a plurality of photosensitive bodies arranged so that longitudinal directions are the same direction and that optically scans the plurality of photosensitive surfaces in the longitudinal direction, wherein a diameter of at least one of the plurality of photosensitive bodies is different from diameters of the other photosensitive bodies in a cross section perpendicular to the longitudinal direction, and in the cross section perpendicular to the longitudinal direction, a sign of $\theta 1$ and a sign of $\theta 2$ are different, wherein $\theta 1$ (rad) denotes an incident angle of a light flux incident on a first photosensitive body with a smallest diameter among the plurality of photosensitive bodies, and $\theta 2$ (rad) denotes an incident angle of a light flux incident on a second photosensitive body with a largest diameter, and a condition $$|\theta 1|>|\theta 2|>0$$

is satisfied.

2. The image forming apparatus according to claim 1, wherein in the cross section perpendicular to the longitudinal direction, conditions $$|\theta 1|\geq 3/\phi 1+1.64\lambda/S$$

$$|\theta 2|\geq 3/\phi 2+1.64\lambda/S$$

are satisfied, wherein $\phi 1$ denotes the diameter of the first photosensitive body, $\phi 2$ denotes the diameter of the second photosensitive body, $\lambda$ denotes a wavelength of the light fluxes incident on the first photosensitive body and the second photosensitive body, and S denotes a spot diameter of the light fluxes in a sub-scanning direction on the photosensitive surfaces of the first photosensitive body and the second photosensitive body.

3. The image forming apparatus according to claim 2, wherein a condition $$0.43>|\theta 1|>|\theta 2|\geq 3/\phi 2+1.64\lambda/S$$

is satisfied.

4. The image forming apparatus according to claim 1, wherein a condition $$0.31\geq\Delta\theta$$

is satisfied, wherein $\Delta\theta$ (rad) denotes a maximum value of difference between magnitudes of the incident angles of the light fluxes incident on the plurality of photosensitive bodies.

5. The image forming apparatus according to claim 1, wherein the second photosensitive body is a photosensitive body that forms a black image.

6. The image forming apparatus according to claim 1, wherein the light scanning apparatus comprises a plurality of light scanning apparatuses including a light scanning apparatus for black and light scanning apparatuses for color, a configuration of the light scanning apparatus for black and a configuration of the light scanning apparatuses for color are different, and the light scanning apparatuses for color have the same configuration.

7. The image forming apparatus according to claim 1, wherein the light scanning apparatus comprises a plurality of light scanning apparatuses each of which optically scans each of the plurality of photosensitive surfaces.

8. The image forming apparatus according to claim 7, wherein the plurality of light scanning apparatuses are aligned in a direction perpendicular to the longitudinal direction, and wherein the light scanning apparatus that optically scans the photosensitive surface of the second photosensitive body are not arranged among the other light scanning apparatuses.

9. The image forming apparatus according to claim 8, wherein the second photosensitive body is a photosensitive body that forms a black image.

* * * * *